United States Patent [19]

Batchelor et al.

[11] Patent Number: 4,641,509

[45] Date of Patent: Feb. 10, 1987

[54] MASTER KEYBOARD

[76] Inventors: Ronnie K. Batchelor, 109 S. Carolina Ave., Spencer, N.C. 28145; Ronnie R. Rowe, 207 Eastwood Dr., Salisbury, N.C. 28144

[21] Appl. No.: 787,958

[22] Filed: Oct. 16, 1985

[51] Int. Cl.[4] ..... E05B 11/00

[52] U.S. Cl. ..... 70/388; 70/389; 70/429; 70/430; 40/19.5; 211/8

[58] Field of Search ..... 70/389, 456 R, 388, 70/429, 430; 40/19.5; 220/210; 211/4, 8, 9, 59.1, 60.1

[56] References Cited

U.S. PATENT DOCUMENTS

| | | | |
|---|---|---|---|
| 287,623 | 10/1883 | Camp | 211/59.1 |
| 733,963 | 7/1903 | Hinman | 211/9 |
| 2,179,947 | 11/1939 | Miller | 70/388 |
| 2,405,369 | 8/1946 | Poulsen et al. | 40/19.5 |
| 2,491,337 | 12/1949 | Segal | 70/429 |
| 2,889,050 | 6/1959 | Modrey | 211/4 |
| 3,019,634 | 2/1962 | Roberson | 70/388 |
| 3,430,469 | 3/1969 | Baxter et al. | 70/388 |
| 4,472,952 | 9/1984 | Hollowell, Jr. | 70/389 |
| 4,567,741 | 2/1986 | Trempala | 70/389 |
| 4,570,469 | 2/1986 | Neilsen | 70/389 |

*Primary Examiner*—Gary L. Smith
*Assistant Examiner*—Suzanne L. Dino
*Attorney, Agent, or Firm*—Ralph H. Dougherty

[57] ABSTRACT

A master key board device for the retention, protection, and control of keys. The device is preferably wall mountable, having a face plate containing slots for a desired number of keys. Each key slot has an associated locking device which is controlled by a universal key. The locking device carries an arm which engages specially modified keys to retain them in the key board, and releases them to persons having the proper universal key, but retains the universal key, so that keys can be removed from only one slot by each universal key.

11 Claims, 5 Drawing Figures

MASTER KEYBOARD

BACKGROUND OF THE INVENTION

The present invention relates to a device for the retention, protection, and control of keys. The device is a key board, which is preferably wall mountable, having a face plate containing slots for any desired number of keys. Each key slot has an associated locking device with means for retaining a key within the slot, the locking device being controlled by a universal key.

In any business where inventory is controlled by key operated locks, the business owner or manager must maintain the keys to such locks in an orderly fashion in a location to which employees will have ready access and where they can be removed by any sales person, or other authorized employee, yet cannot be removed by an unauthorized person. Such businesses include new and used automobile vehicle dealerships, as well as dealerships for other types of motor vehicles such as trucks, campers, motor homes, and the like. Real estate offices and leasing agents also have experienced some problems in regard to control of keys to homes, apartments, buildings, or commercial space in their inventory.

Heretofore, keys to inventory have normally been placed on keyboards where one or more keys hangs from a pin or peg. In order to safeguard these keys, a whole board is usually placed within a cabinet which may be lockable.

An automobile dealer usually wishes to prevent a car salesman from taking more than one key at a time in order to avoid tying up two vehicles and preventing another salesman from demonstrating a second vehicle because the first salesman has taken the key. The present invention allows such control of keys by the dealer.

OBJECTS OF THE INVENTION

It is the principal object of the subject invention to provide an apparatus for safeguarding keys.

It is another object of this invention to provide means for control of keys.

It is an additional object of this invention to provide an apparatus for retaining keys securely therein, and means for removing keys from a single location on said apparatus by use of a universal key.

It is also an object of the present invention to provide apparatus for safeguarding keys which will retain a universal key within the apparatus until the removed key is replaced.

It is also an object of this invention to provide a means for preventing a single individual from removing keys from more than one location on the device at a time.

SUMMARY OF THE INVENTION

The present invention is a key retainer device, or master key board or box, which is wall mountable, containing slots for any desired number of keys. Each key slot is controlled by an associated universal lock, such as is found on soft drink boxes, opened by a universal key, one of each is issued to each person authorised to remove a key or set of keys from the master key board.

DETAILED DESCRIPTION OF THE DRAWINGS

The foregoing and other objects of the invention will become more readily apparent by referring to the following detailed description and the appended drawings in which.

DETAILED DESCRIPTION

Figure 1:
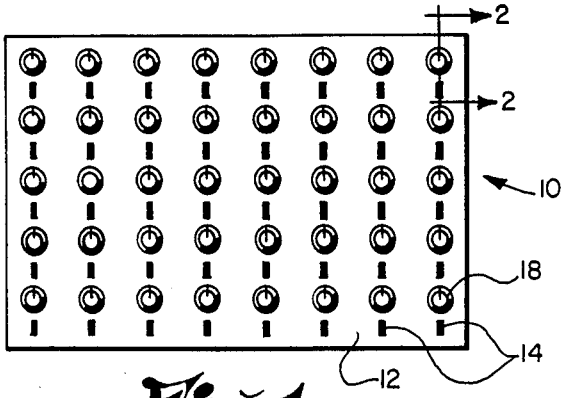
FIG. 1 is a front elevational view of the invented master key box apparatus.
Figure 2:
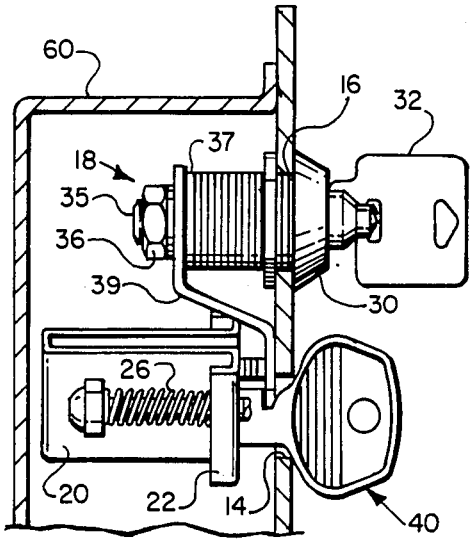
FIG. 2 is a side cross-sectional view of a portion of the key retaining device taken along the line 2—2 of FIG. 1.
Figure 3:
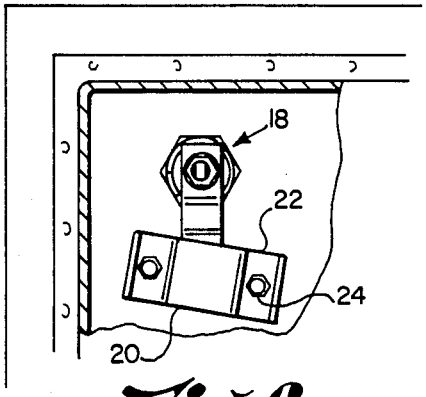
FIG. 3 is a rear view of a portion of the device of FIG. 1, with the back partially broken away.

Referring now to the drawings, the face of the master key box or board 10 is preferably a stainless steel plate 12 having a series of key slots 14 provided therein. The slots 14 are preferably the width of a pair of standard keys in order that both the door lock key and the ignition key of an automotive vehicle can be placed within a single slot. Adjacent to each slot 14 in the face of board 10 is a hole 16 having a key retaining mechanism 18 situated therein, as best depicted in FIG. 2. On the back of the plate 12, and associated with each key slot 14, is a receptacle 20, having a flange 22 engaging a pair of pins 24, which are fixed to plate 12, and urged toward the plate 12 by biasing means 26, such as a coil spring or a leaf spring.

Figure 4:
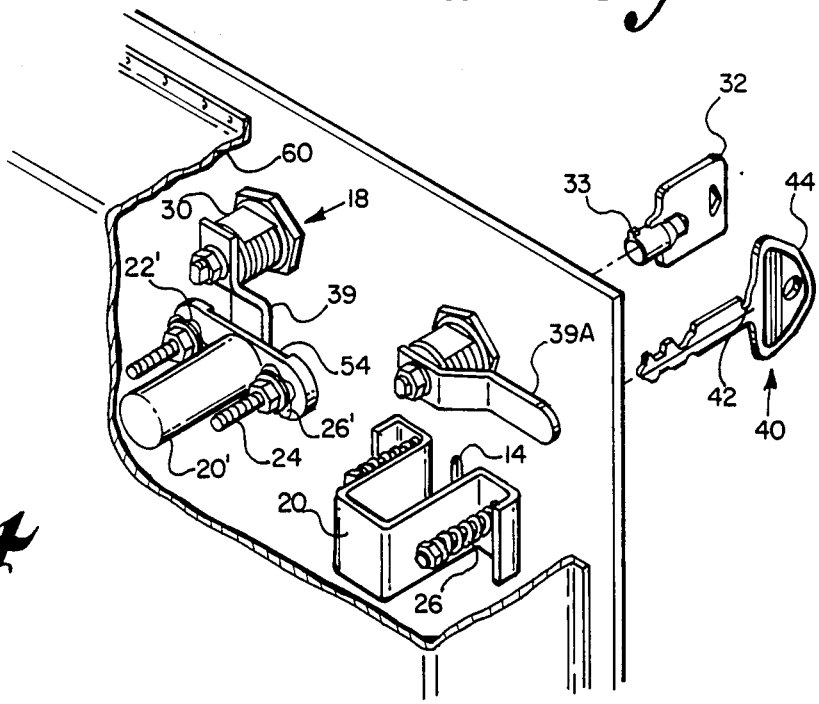
FIG. 4 is an isometric view of a portion of the back of the device of FIG. 1 with a portion of the cover broken away, showing two embodiments of the universal key lock mechanism and key retainer.

The key retaining mechanism 18 includes a universal lock 30 controlled by a universal key 32 shown in FIG. 4, which has a single lug 33 for engaging the operating mechanism of lock 30.

Figure 5:
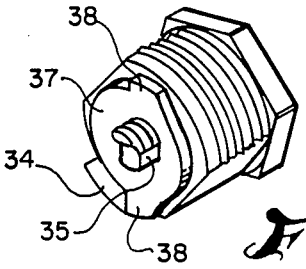
FIG. 5 is an enlarged isometric view of a portion of the universal key lock mechanism.

A stop 34, shown in FIG. 5, on the fixed portion of the universal lock limits the movement of the lock to a predetermined radial distance, preferably about one quarter turn or 90°, but no more than 120°, or it could interfere with adjacent locks, and would be difficult to operate. The moveable central portion 35 of the lock, shown as a threaded shank carrying a nut 36, carries an associated movement limiting device 37, generally similar to a washer, but having movement limiting lugs 38. The device 37 is keyed to the threaded shank 35, as illustrated, by providing one or more flat surfaces for engagement by a similarly configured hole in device 37, or by any other keying means. An associated key engaging arm 39 is fixed to the end of the central shank portion 35 of the lock mechanism, retained thereon by nut 36, and adapted to cover a portion of slot 14 when at one limit of its movement. The arm 39 is preferably keyed to the shank 35 in a similar manner to that of movement limiter 37. Arm 39 is a thin metal strip, bent in such manner that its tongue portion 39A moves closely to or slideably on the reverse surface of plate 12.

In order for the invented device to retain keys within slot 14, each key 40 must be notched as shown in FIG. 4, with a notch 42 near the head 44 of the key.

In operation, the face plate 12 of each keyboard contains a predetermined number of slots 14, each with an associated universal lock 30 and key 32. The keys 40 to be retained are pushed into the slot 14, contacting the bottom of receptacle 20, pushing it away from the board and allowing arm 39 to rotate freely past the flange 22 of the receptacle to the limit of its travel, engaging the notch 42 in the key 40 in key slot 14. The universal key can then be removed from the arm lock 30 and the key 40 will not be removable except by the use of another universal key. To remove the key 40, a universal key 32 is inserted into the universal lock 30, associated with the slot 14 holding the key, spring pressure is released from the key 40 by pushing the key into the slot 14, the universal key is turned to the other limit of its movement, and key 40 is removed from the slot, which releases the pressure on the flange of the receptacle. The spring biasing means 26 urges the receptacle 20, through its flanges, toward the plate 12, limiting the movement of arm 39 by the surfaces 38 contacting stop 34, thus the universal key 32 is retained in the lock until one or a set of properly notched removed keys 40 are replaced into slot 14.

In order to initiate use of the master keyboard, each locking device 30 has a key 32 therein, and the arm 39 is in the non-retentive position. Since the arm 39 cannot pass the flange 22 of receptacle 20, the key 32 cannot be removed. A slot 42 is cut into the shank of each key 44 in the inventory by use of a notching machine, or grinder. As the owner or manager inserts notched keys 44 into a slot 14 in the keyboard, he removes and retains the associated universal key 32. Then one such key 32 is issued to each authorized person. This procedure will assure good control over the key inventory.

Universal keys are commonly available and are usually used in connection with vending machines.

The only portion of the apparatus which could require maintenance is the biasing means 26, which could wear out. Thus the cover or back 60 of the master key box, which is bolted or tack welded into place, is readily removable in case it becomes necessary to replace any springs.

ALTERNATIVE EMBODIMENTS

As stated above, the biasing means can be either coil springs 26 or leaf springs 26' as shown in FIG. 4, and the biasing means alternatively could be any desirable resistant material. FIG. 4 also depicts two alternative receptacle configurations, a box-like structure 20 having bent flanges 22, and a closed tubular receptacle 20' having horizontal flanges 22' attached to the tube near the plate 12. A slot 54 may be provided at the end of the receptacle 20' if desired to accomodate tongue 39A of the 10 arm 39.

Other alternative configurations can be developed utilizing more posts 24, or by utilizing more complex biasing arrangements.

SUMMARY OF THE ACHIEVEMENT OF THE OBJECTS OF THE INVENTION

It is readily apparent that we have invented a security device or master key board for retaining and safeguarding keys. The apparatus includes means for removing keys from only a single location on the board by use of a universal key, and means for retaining the universal key within the apparatus until the removed key is replaced.

What is claimed is:

1. A device for the retention, protection and control of keys, comprising:

a. a face plate being provided with at least one slot adapted to receive at least one key having a notch adjacent the head of such key adapted to accept an arm of a universal locking mechanism;

b. a universal locking mechanism fixed to said plate, spaced from and associated with such slot, such locking mechanism being controllable by a universal key, said mechanism carrying a stop means thereon;

c. a receptacle associated with and mounted about said slot on the reverse side of said plate to receive said at least one key;

d. biasing means attached to the reverse side of said plate and engaging said receptacle for urging said receptacle toward said plate;

e. an arm fixed to the universal locking mechanism on the reverse side of said plate, and adapted to move into a first position to cover a portion of said slot and engage said notch on said at least one key when at one limit of its movement, and to move to a second position remote from said slot when at the other limit of its movement; and f. a movement limiting means associated with said arm for engagement with said stop means at the limit of movement of said arm.

2. A device according to claim 1 wherein the limit of movement of said arm is 120 radially.

3. A device according to claim 1 wherein said receptacle is mounted about said slot on a pair of upstanding pins attached to said plate and flanking said slot.

4. A device according to claim 3 wherein said biasing means is a coil spring mounted on each of said pins.

5. A device according to claim 3 wherein said biasing means is a leaf spring mounted on each of said pins.

6. A device according to claim 1 wherein said receptacle is a closed tube.

7. A device according to claim 1 wherein said face plate is stainless steel.

8. A device according to claim 1 further comprising a cover on the reverse side of said plate enclosing the key retaining mechanism.

9. A device according to claim 8 wherein said cover is welded to said plate.

10. A device according to claim 8 wherein said cover is bolted to said plate.

11. A device according to claim 1 wherein said arm has an associated movement limiter having a lug adapted to strike said stop means to limit movement of said arm.

* * * * *